United States Patent [19]

Longsworth

[11] Patent Number: 5,012,650

[45] Date of Patent: May 7, 1991

[54] CRYOGEN THERMAL STORAGE MATRIX

[75] Inventor: Ralph Longsworth, Allentown, Pa.

[73] Assignee: APD Cryogenics, Inc., Allentown, Pa.

[21] Appl. No.: 419,766

[22] Filed: Oct. 11, 1989

[51] Int. Cl.[5] ..... F25B 19/02

[52] U.S. Cl. ..... 62/51.2; 62/6; 165/4

[58] Field of Search ..... 62/6, 51.1, 51.2; 165/4

[56] References Cited

U.S. PATENT DOCUMENTS

| | | | |
|---|---|---|---|
| 3,069,042 | 12/1962 | Johnson | 62/51.3 |
| 3,148,512 | 9/1964 | Hoffman et al. | 62/6 |
| 3,292,501 | 12/1966 | Verbeek | 62/6 |
| 3,339,627 | 9/1967 | Van Geuns et al. | 165/4 |
| 3,367,406 | 2/1968 | Vonk et al. | 165/4 |
| 3,371,145 | 2/1978 | Camille, Jr. | 62/51.3 |
| 3,375,867 | 4/1968 | Daunt | 62/6 |
| 3,415,054 | 12/1968 | Shulze | 62/6 |
| 3,445,910 | 5/1969 | Duryee et al. | 62/6 |
| 3,794,110 | 2/1974 | Severijns | 62/6 |
| 3,818,720 | 6/1974 | Campbell | 62/51.2 |
| 3,960,204 | 6/1976 | Horn | 62/6 |
| 4,231,418 | 11/1980 | Lagodmos | 62/6 |
| 4,359,872 | 11/1982 | Goldowsky | 62/6 |
| 4,487,253 | 12/1984 | Malek et al. | 62/6 |
| 4,781,033 | 11/1988 | Steyert et al. | 62/51.2 |

*Primary Examiner*—Ronald C. Capossela

*Attorney, Agent, or Firm*—Helfgott & Karas

[57] ABSTRACT

Thermal storage matrices, particularly useful in conjunction with the cooling of the infra-red detectors employed in space related or missile guidance systems are taught. Also taught are cryostat assemblies, including such thermal storage assemblies.

11 Claims, 2 Drawing Sheets

CRYOGEN THERMAL STORAGE MATRIX

FIELD OF THE INVENTION

This invention relates to the field of thermal storage matrices and more particularly to the field of thermal storage matrices for use in conjunction with cooling applications such as for infra-red detectors employed in space related or missile guidance applications.

BACKGROUND OF THE INVENTION

In the utilization of IR (infrared) detectors it is necessary to cool the detector under cryogenic conditions (<120K) in order for it to operate properly. Generally, heat exchange devices known as cryostats have been employed for this purpose. These devices either operate continuously or they can be used to generate an inventory of liquid which then keeps the detector cool as it evaporates.

Furthermore, for various space related applications of IR detectors, it is also possible to utilize the vacuum of space to reduce the vapor pressure over a cryogen below its normal boiling temperature even to the point where it will freeze and permit cooling of the detector below the triple point temperature of the cryogen, e.g., <63° K for $N_2$ and <14° K for $H_2$. In order to do this, it is necessary to form or collect the liquid cryogen in a matrix that will retain the cryogen while the pressure is reduced. The liquid boils and possibly freezes, then heat is transferred from the detector to the liquid or solid cryogen as it evaporates or sublimes. The matrix must thus be effective in transferring heat to the cryogen in the matrix.

For continuous flow cryostats this same type of matrix can be used to stabilize the temperature if the cryostat flow varies as it does with demand flow type cryostats (Ref. U.S. Pat. No. 3,828,868 by R. C. Longsworth).

A matrix of 150 mesh copper screen has been tried as a means of trapping liquid cryogen and found to be totally ineffective due to the fact that the rapid boiling of the liquid within the screens when the pressure is reduced blows most of the liquid out of the screens.

Fine wire mesh has been used as a wick in cryogenic heat pipes (2,400 wires/in.). Attempts have been made to use fine wire mesh pads of copper or gold to trap some liquid to stabilize the temperature of demand flows cryostats. These by and large have been ineffective because the boiling action blows the liquid out of the mesh pad.

SUMMARY OF THE INVENTION

In the invention of the present application a matrix is formed by rolling one or more layers of glass fiber paper (such as that used in superinsulation) in between copper wire screen (150 mesh). The glass paper very effectively adsorbs liquid cryogens, and the copper screen transfers heat in and out of the matrix and allows a path for the gas to escape from the matrix without blowing out the liquid as it evaporates. Such a matrix will cool an IR detector to 12° K by vacuum pumping liquid hydrogen adsorbed in the matrix, and can be utilized quite effectively to stabilize the temperature of IR detectors cooled with liquid nitrogen from demand flow cryostats.

While cooling of IR detectors is currently the primary application for this technology it may also be applied to other devices requiring the use of JT cooling with equal benefit.

A highly effective thermal storage matrix for use in conjunction with the cryogenic cooling of infra-red detectors is achieved by rolling one or more layers of highly adsorbent glass fiber paper between copper wire screen of approximately 150 mesh.

DETAILED DESCRIPTION OF THE INVENTION

Figure 1A:
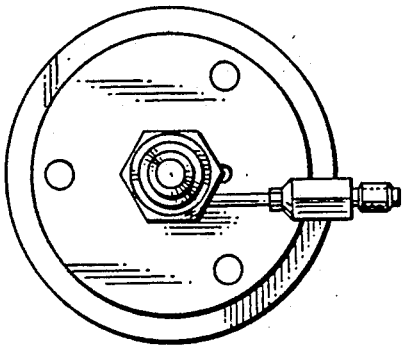
FIG. 1 is a cross-sectional view of a typical cryostat assembly showing the location of the matrix.

In exploring various materials which would adsorb liquid cryogen in a manner similar to a blotter, it was found that cotton, wool, synthetic wools with fine fibers, and glass fiber paper, such as is used in superinsulation, applications were effective. Because of its ability to withstand soldering and brazing temperatures, 500° and 1200° F., the glass fiber paper was selected for use to demonstrate the concept of the present invention. In order to provide heat transfer into a volume of glass paper, a roll was made consisting of two layers of glass paper and a sheet of 150 mesh copper wire screen. This has been found to be very effective in solving both of the problems heretofore encountered in cryogenic cooling applications of IR detectors.

When used in the present application the term "a glass fiber paper" is defined to mean a thin pliable sheet of felted glass fibers. "Felted" means that the glass fibers are laid down in plains atop each other in a random orientation.

In carrying out the work done to demonstrate the effectiveness of the concept of the present invention, a glass fiber, Type 400A, produced by Pallflex Products Corporation, Putnam, Connecticut, was utilized. This glass fiber paper was measured to have fiber diameters of 1 to 2 $\mu$ (microns, 1 $\mu=10^{-6}$ m) and a thickness of 100 $\mu$ (0.004 in.).

As noted earlier, a number of different materials have been identified as potentially useful in the invention of the present application in addition to the glass fiber paper utilized to demonstrate the concept.

In order for any material to be useful as a component of the thermal storage matrix of the present invention it must meet certain criteria.

The capillary pressure, $P_c$, that determines the ability of a material to absorb liquids is given by:

$$P_c=2\gamma(\cos\Theta)/r_c$$

$\gamma$ surface tension of liquid
$\Theta$ wetting angle with surface
$r_c$ capillary radius To be effective as a "wick", i.e., have a large capillary pressure, the material must have a good wetting angle for the cryogen of interest in the range $\pi<\Theta<2\pi$ and must have a very small pore size.

Stainless steel, 1,500 mesh, has been reported to be a good wick for liquid nitrogen (U.S. Pat. No. 3,892,273), and we have observed that glass fiber paper and polyester cotton are good wicks. Therefore, it is deduced that they have good wetting properties even though no measurements of 8 are available.

Sample values of surface tension for typical materials are:

| Liquid | Temp K. | γ - dynes/cm |
|---|---|---|
| hydrogen | 16 | 2.66 |
| | 20 | 1.98 |
| nitrogen | 70 | 10.53 |
| | 80 | 8.27 |
| argon | 84 | 11.46 |
| | 90 | 10.53 |

Based on surface tension data, liquid nitrogen and argon will have capillary pressures about five times greater than liquid hydrogen for a given capillary size.

Values of capillary radius for selected materials are estimated as follows:

| Material | Fiber Size μ | Estimated Capillary Radius μ |
|---|---|---|
| glass fiber paper | 1 to 2 dia | 0.5 to 1 |
| polyester cotton | 5 × 40 | 5 to 40* |
| 1,500 mesh wire S.S. | 8.5 | 5 |
| 150 mesh wire S.S. | 85 | 50 |

*Depends on how tightly it is packed.

The very small capillary radius of glass fiber paper explains why it was found to be such an effective absorbent.

While 150-mesh copper screens were found to be effective in carrying out the demonstration experiments for the concept of the present invention it is to be understood that coarser screens would also work. The screen is not intended to serve as a wick, so finer meshes are not desirable even if they were available. The screen must have large enough pores so that the gas evaporating from the liquid can escape from the matrix without entraining liquid and at the same time transfer heat through the matrix. Copper or aluminum which have high thermal conductivities at cryogenic temperature make good screen materials.

Fine mesh wire screen 100 to 150 mesh (wire/in.) are preferred for a small cryogen storage matrix, i.e., 1-cm thick while coarse wire screen, 25 mesh, would be good for a larger matrix, i.e., 5-cm thick. Similarly, the thickness of glass paper depends on parameters that have not yet been explored but the basic concept is that the cryogenic liquid stored in the paper will evaporate on the surface, and heat will flow from the interior by conduction. The paper would be too thick if vapor bubbles form within the paper and force liquid out.

Fiberglass paper is quite dense and is not affected by how tightly a roll of wire mesh and paper is wound. A loose fiber material, such as the polyester cotton, should be rolled as tightly as possible to minimize the effective pore size, i.e. 5 μ is better than 40 μ.

Spacing between the layers of adsorbent material is set by the coarseness of the copper wire screen. The screen needs to be in good thermal contact with the adsorbent, so the matrix should be rolled or packed tightly. Coarse sintered type materials having high thermal conductivity may be used in place of screens. The matrix may alternately be constructed by stacking in layers.

Figure 1B:
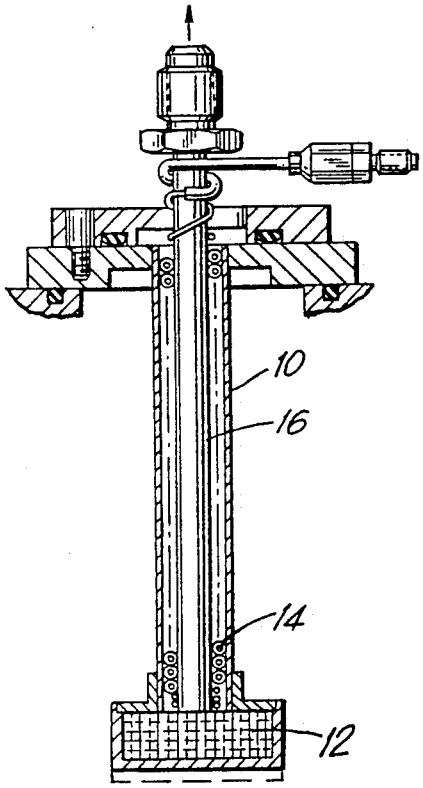
Figure 1C:
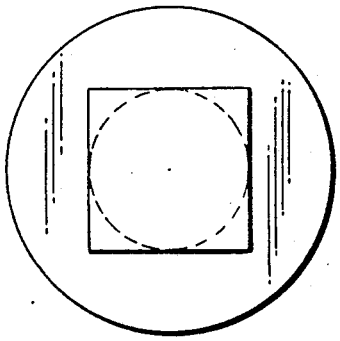

With reference to the drawings, FIG. 1 shows one application for the thermal storage matrix of the present invention where the matrix receives liquid nitrogen directly from a Joule-Thompson cryostat. In operation, the cryostat uses high pressure $N_2$ to cool down the cryostat (10) and matrix (12), which produces the liquid that is adsorbed by the matrix. After the matrix is saturated, flow is stopped, and the cryostat is vented to vacuum through the finned tube heat exchanger (14) and/or the mandrel (16). Temperatures well below the freezing temperature of $N_2$, 63° K were achieved. Any temperature within the range of the minimum that can be achieved and the critical temperature for a given cryogen can be maintained by regulating the pressure at which the cryogen is evaporating.

Figure 2:
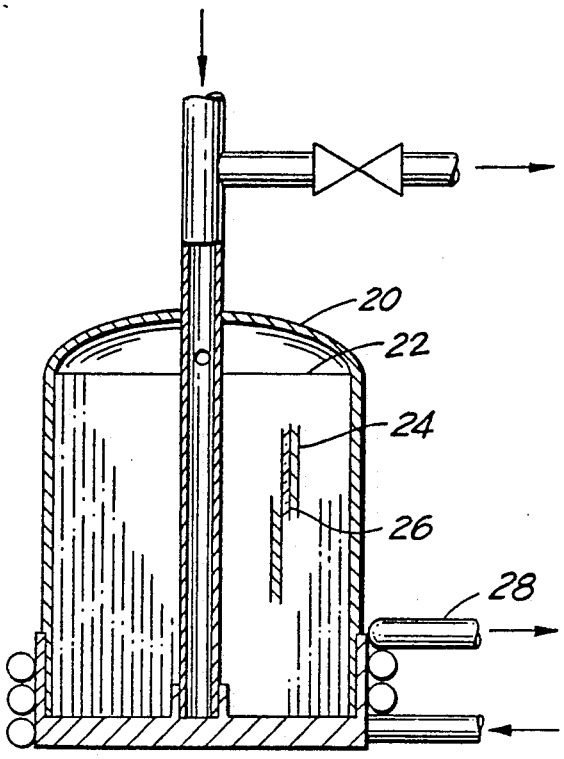
FIG. 2 is a cross-sectional view of a typical solid/liquid cryogen Pot Assembly showing the construction details.

FIG. 2 shows the construction of an $H_2$ pot assembly (20) with a matrix (22) comprising two layers of glass paper, (24) rolled between layers of 150 mesh Cu (26) screening which is used to condense liquid hydrogen (by cooling it with $LH_2$ in tubes wrapped around the outside (28)), then pump on it to produce a solid. The effectiveness of the matrix to retain the cryogen was demonstrated by doing this in an inverted position so the pump-out tube was pointed down. The copper screen was effective in transferring heat from the base which was maintained at 12.7 K for 19 seconds.

Figure 3:
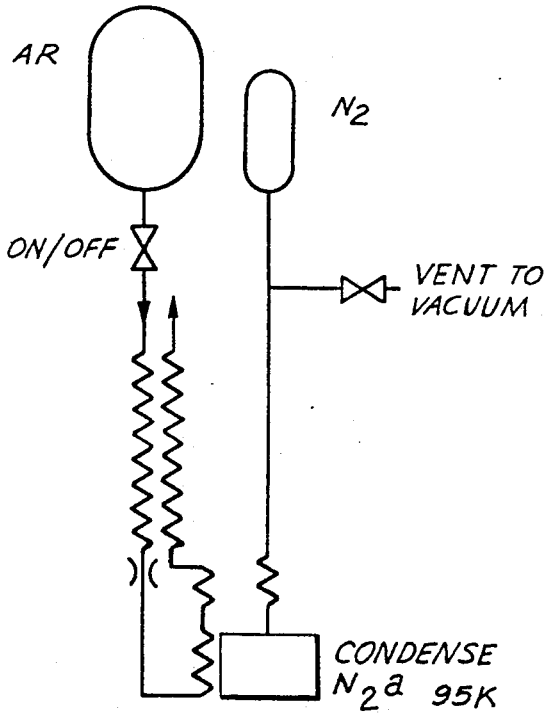
FIG. 3 is a schematic representation of a JT cooling system that uses the Pot Assembly.

FIG. 3 shows a schematic representation of a JT cryostat with separate liquid/solid cryogen storage pot. This arrangement uses an AR JT cooler to condense $N_2$ in the pot at 95°K (80 psia), after which the flow of Ar is stopped and the valve opened to vent the $N_2$ to vacuum, or some low pressure. The $N_2$ in the pot will boil as the pressure is reduced and the temperature will thus drop. The final temperature will be determined by the vent pressure.

While the invention has been described with respect to the various embodiments, it is to be understood that the invention is not limited thereto and can be practiced within the scope of the various claims.

I claim:

1. A thermal storage matrix for the collection and storage of liquid and solid cryogens for use in conjunction with the cooling of detectors by liquid or solid cryogens, comprising multiple layers of at least one highly adsorbent material which effectively adsorbs liquid cryogens and at least one relatively porous material which exhibits high thermal conductivity at cryogenic conditions and transfers heat in and out of the matrix and allows a path for a gas, generated as a liquid cryogen evaporates, to escape, without blowing the liquid out from said at least one highly adsorbent material.

2. A thermal storage matrix according to claim 1, wherein the highly adsorbent material used exhibits a high capillary pressure relative to the liquid to be adsorbed.

3. A thermal storage matrix according to claim 1, wherein the highly adsorbent material is selected from the group comprising cotton, wool, synthetic wool, stainless steel mesh and glass fiber paper.

4. A thermal storage matrix according to claim 1, wherein the highly adsorbent material is glass fiber paper.

5. A thermal storage matrix according to claim 1, wherein the porous material is selected from the group comprising copper or aluminum wire mesh screen.

6. A thermal storage matrix according to claim 1, wherein the porous material is copper wire mesh.

7. A thermal storage matrix according to claim 1, wherein the porous material is wire mesh screening which has a mesh of from 25 to 150.

8. A thermal storage matrix according to claim 1, wherein the highly adsorbent material is glass fiber paper and the porous material is 150 mesh copper wire.

9. A thermal storage matrix according to claim 1, wherein multiple layers are formed by rolling alternating sheets of adsorbent and porous material.

10. A thermal storage matrix according to claim 1, wherein multiple layers are formed by stacking alternating sheets of said adsorbent and porous material.

11. A cryostat assembly for use in cooling infra-red detectors in space applications including a thermal storage matrix according to claim 1.

* * * * *